US007274293B2

(12) United States Patent
Bradus et al.

(10) Patent No.: US 7,274,293 B2
(45) Date of Patent: Sep. 25, 2007

(54) CABLE LOCK FOR SECURITY SYSTEM

(75) Inventors: Robert Bradus, Bel Air, MD (US); Lawrence E Milburn, Bel Air, MD (US); James B Watson, Fallston, MD (US); Peter W Bressler, Philadelphia, PA (US); John D Coleman, Philadelphia, PA (US); David Schiff, Highland Park, NJ (US)

(73) Assignee: Black & Decker Inc., Newark, DE (US)

( * ) Notice: Subject to any disclaimer, the term of this patent is extended or adjusted under 35 U.S.C. 154(b) by 190 days.

(21) Appl. No.: 11/010,732

(22) Filed: Dec. 13, 2004

(65) Prior Publication Data

US 2006/0109115 A1 May 25, 2006

Related U.S. Application Data

(60) Provisional application No. 60/626,728, filed on Nov. 11, 2004.

(51) Int. Cl.
*G08B 13/14* (2006.01)

(52) U.S. Cl. ..... 340/568.2; 340/686.2; 340/621; 340/571; 340/687; 340/427; 340/432

(58) Field of Classification Search ..... 340/568.2, 340/686.2, 621, 571, 687, 427, 432
See application file for complete search history.

(56) References Cited

U.S. PATENT DOCUMENTS 4,663,611 A 5/1987 Humphrey ..... 340/542
4,776,188 A 10/1988 Dalaba et al. ..... 70/49
5,191,314 A 3/1993 Ackerman et al. ..... 340/542
5,410,301 A * 4/1995 Dawson et al. ..... 340/5.33
5,650,766 A * 7/1997 Burgmann ..... 340/539.11
5,836,002 A * 11/1998 Morstein et al. ..... 340/568.1
6,243,005 B1 * 6/2001 Haimovich et al. ..... 340/427
6,420,971 B1 * 7/2002 Leck et al. ..... 340/542
2002/0113704 A1 8/2002 Hess ..... 340/568.2

* cited by examiner

*Primary Examiner*—Tai Nguyen
(74) *Attorney, Agent, or Firm*—Harness, Dickey & Pierce, P.L.C.

(57) ABSTRACT

A cable lock device includes a housing, a tampering subsystem, and a cable having a first end and a second end. The first end is attached to the housing and is electrically connected to the tampering subsystem and the second end is selectively attached to the housing. In addition, a switch is disposed within the housing and is electrically connected to the tampering subsystem. The switch is movable between an open state and a closed state to indicate when the second end is attached to the housing. The tampering subsystem includes control circuitry that monitors the position of the switch and the status of the cable to detect removal of the second end from the housing and/or severance of the cable. The control circuitry relays status information of the cable lock device to a control unit via a transmitter to alert a property owner of a security breach.

16 Claims, 8 Drawing Sheets

CABLE LOCK FOR SECURITY SYSTEM

This application claims priority under 35 U.S.C. §119(e) to U.S Provisional Application No. 60/626,728 filed on Nov. 11, 2004, and entitled "Cable Lock for Security System" the specification and drawings of which are hereby expressly incorporated by reference.

FIELD OF THE INVENTION

The present invention relates to security systems and more particularly to a portable security system having a cable lock tied to a transmitter.

BACKGROUND OF THE INVENTION

In today's society it is desirable to protect personal effects in one's dwelling, building, or construction site. In doing so, it is desirable to have a security system that is monitored by a remote monitoring station. Ordinarily, central monitored security systems are secured permanently in the walls of the dwelling or building to protect against entry and/or theft. For those persons who temporarily use a structure or building such as a contractor or lessee, it is cost prohibitive to invest in a security system, which, upon leaving the building, would be left behind. Thus, it is desirable to have a portable security system.

Portable security systems exist which include various types of features. Ordinarily, such portable security systems include a wireless sensor that communicates with the security system. The sensor monitors an area or object and sends a signal to the security system indicative of the state of the area or location of the object. For example, some portable security systems may include a motion sensor positioned within a building or at a construction site to detect unwanted intrusion. In addition, the security system can include a vibration sensor tied to object to sense when the object is moved or otherwise disrupted. In either situation, the sensor produces a signal indicative of the state of the respective sensor and sends the signal to the security system for processing.

The security system receives and processes the signals from the respective sensors. If the security system determines that at least one of the sensors detects a security breach, the system alerts the user via an audible siren and/or a wireless transmission. In any event, such security systems provide the user with the convenience of a security system and the practicability of moving the security system from location to location. Thus, it is justifiable for temporary building users to purchase portable security systems.

SUMMARY OF THE INVENTION

Accordingly, a cable lock device is provided and includes a housing, a tampering subsystem disposed within the housing, and a cable having a first end and a second end. The first end is fixedly attached to the housing and is electrically connected to the tampering subsystem and the second end is selectively attached to the housing. In addition, a switch is disposed within the housing and is electrically connected to the tampering subsystem. The switch is movable between an open state and a closed state to indicate when the second end of the cable is attached to the housing. The tampering subsystem includes control circuitry that monitors the position of the switch and the status of the cable to detect removal of the second end from the housing and/or severance of the cable at any point along its length. The control circuitry relays status information of the cable lock device to a control unit via a transmitter to alert a property owner of a security breach.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figures 1, 1A:
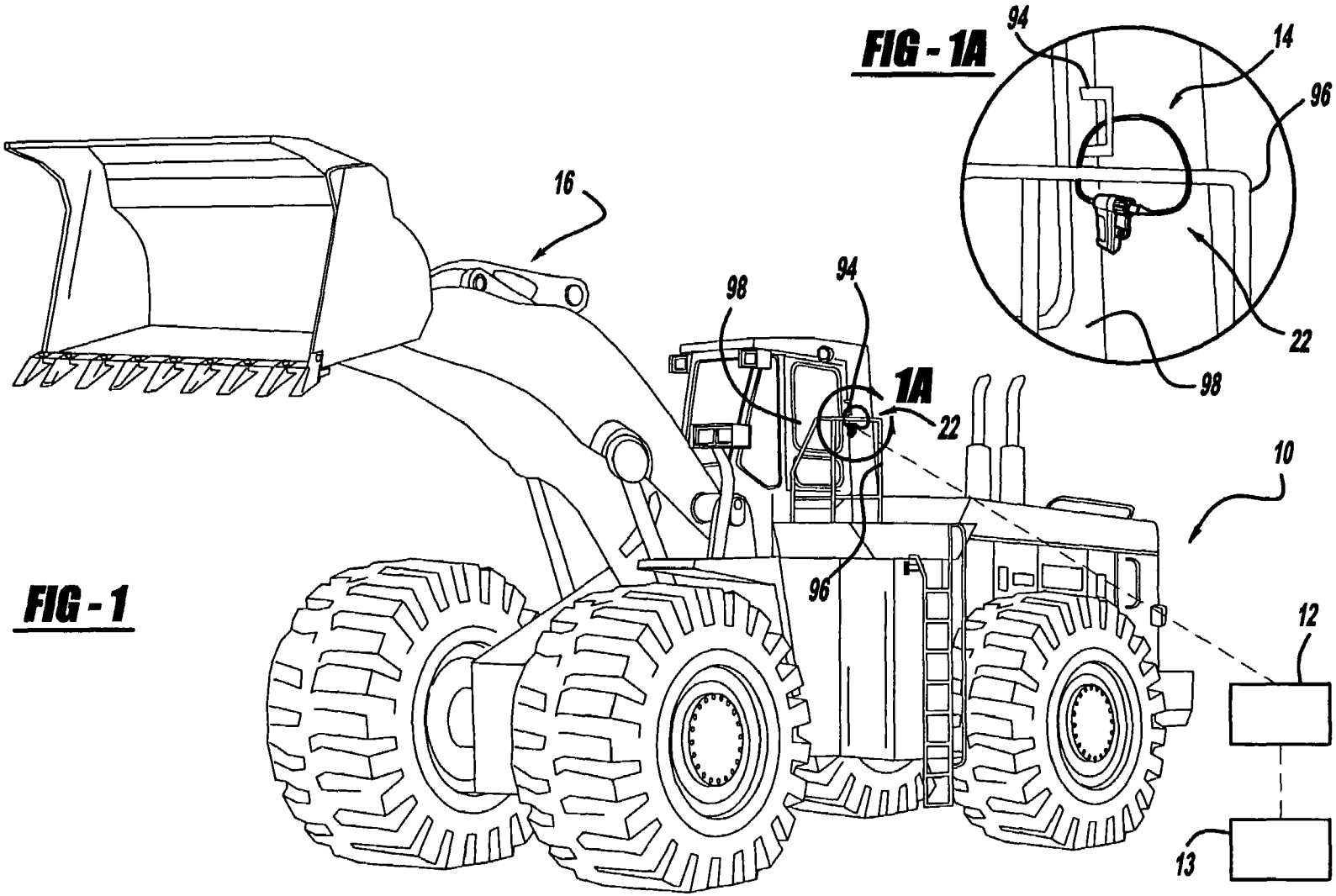
FIG. 1 is an environmental view of a security system in accordance with the principals of the present invention.
FIG. 1A is a more detailed environmental view of a cable lock device for use with the security system of FIG. 1.
Figure 2:
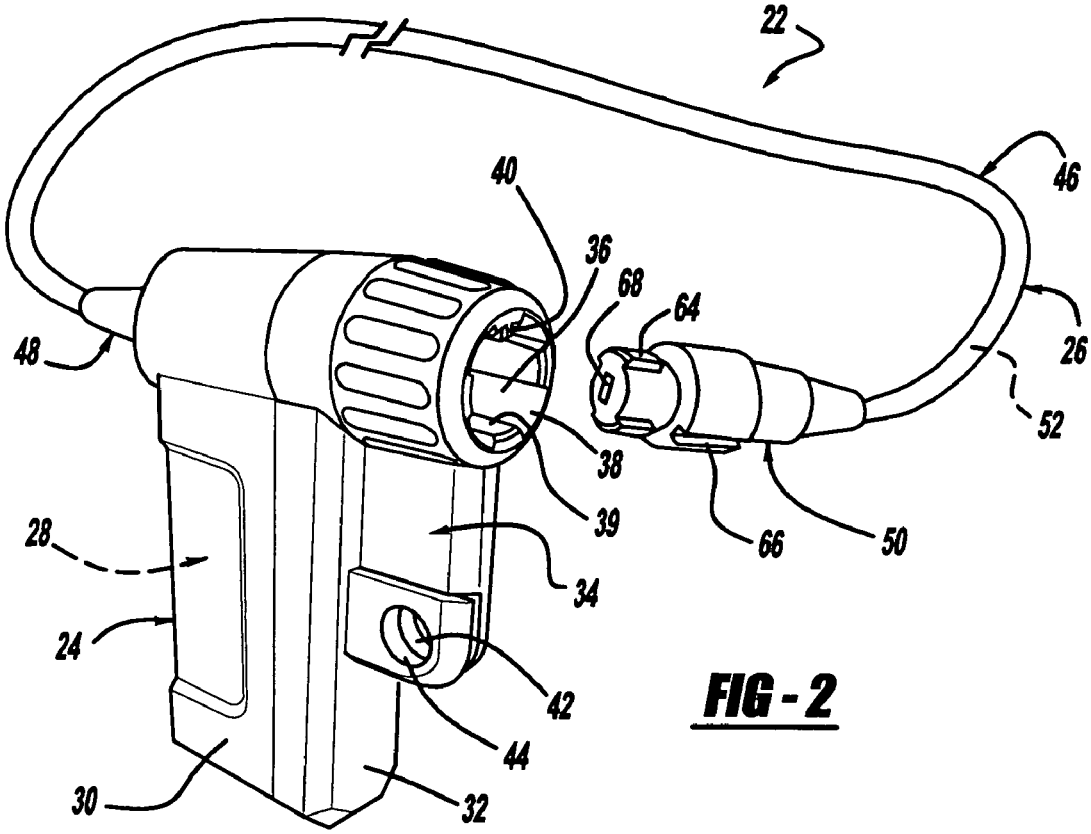
FIG. 2 is a perspective view of a cable lock device for the security system of FIG. 1A in an unlocked state.
Figure 3:
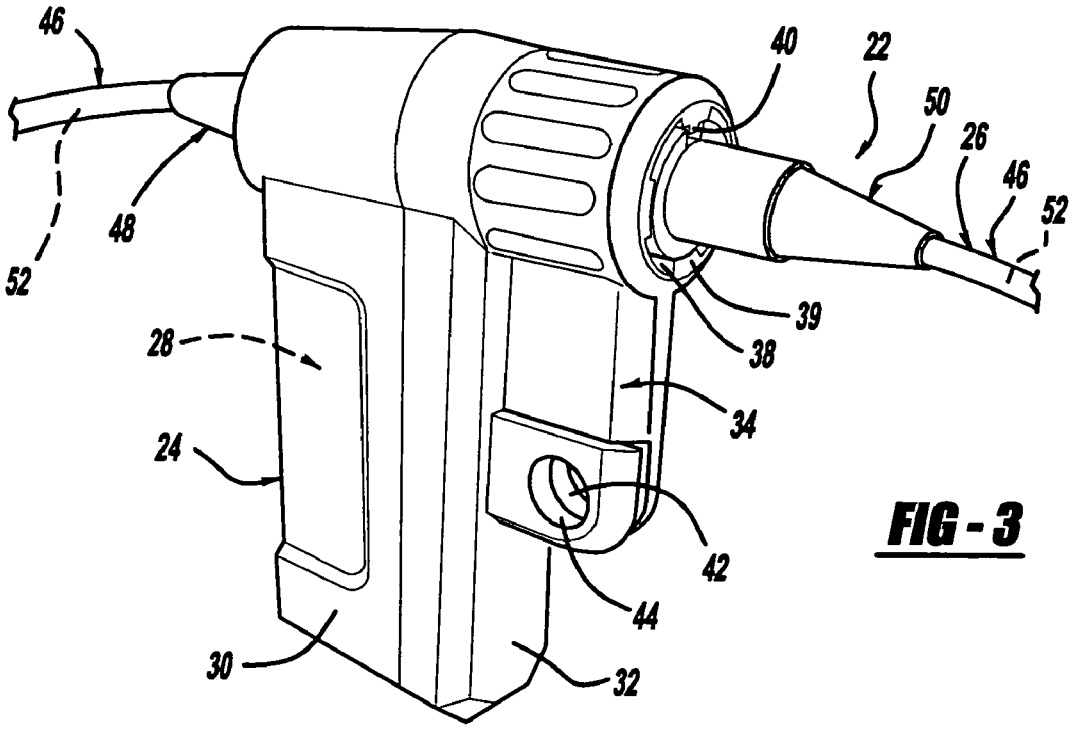
FIG. 3 is a perspective view of the cable lock device of FIG. 1A in a locked state.

The following description of the preferred embodiment(s) is merely exemplary in nature and is in no way intended to limit the invention, its application, or uses.

With reference to the figures, a security system 10 is provided and includes a control unit 12 and at least one sensor 14 that detects a triggering event and sends an event message to the control unit 12. The sensors 14 detect unwanted intrusion into a structure or dwelling and/or unwanted entry, displacement, or theft of an object such as a front loader 16. The sensors 14 produce an event message indicative of the status of each location and/or object and communicate such information to the control unit 12. The control unit 12 receives the information from the respective sensors 14 and determines the status of each location and/or object. Should the sensors 14 indicate that unwanted intrusion into the structure, or theft of the object, the control unit 12 alerts an owner of the property by sounding an alarm (not shown). In addition to sounding an alarm, the control unit 12 may also call a remote monitoring system 13 when the triggering event is determined to further alert the owner of the property and/or a response unit such as a police or fire department.

With particular reference to FIGS. 2-5, one of the sensors 14 of the security system 10 is a cable lock device 22 for use with the control unit 12 and includes a housing 24, a cable assembly 26, and tampering subsystem 28. The housing 24 includes a clam-shell design having separable halves 30, 32 and a lock fitting 34 rotatably supported by the housing 24 generally adjacent half 32. The lock fitting 34 includes an attachment recess 36, a plurality of grooves 38, a plurality of locking projections 39, and a guidepost 40. The projections 39 and guidepost 40 extend into the recess 36, with each projection being circumferentially spaced apart by a groove 38. Furthermore, the lock fitting 34 includes a lock aperture 42 for selective alignment with a lock aperture 44 of the housing 24, as will be described further below.

Figure 4:
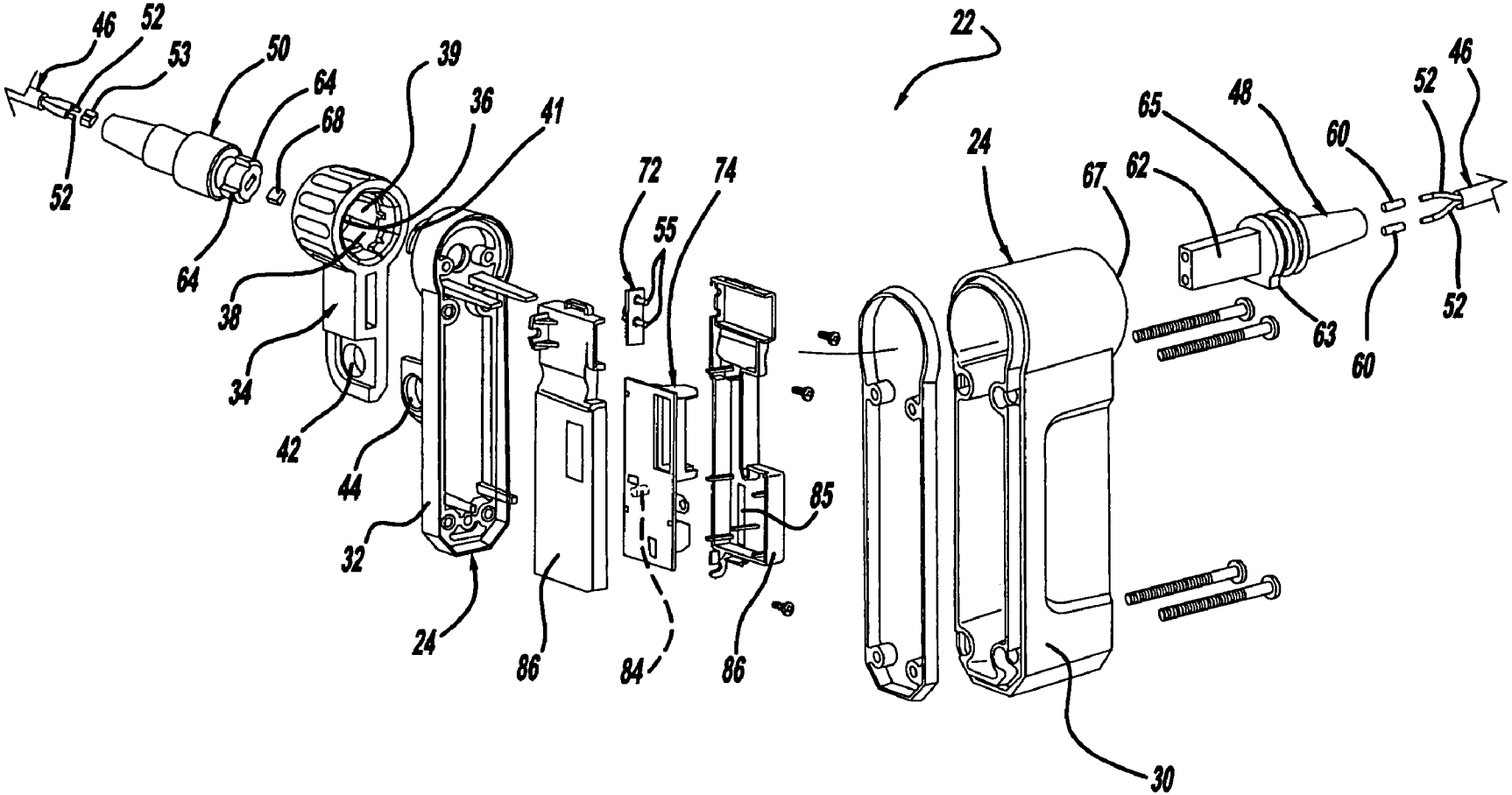
FIG. 4 is an exploded view of the cable lock device of FIG. 1A.
Figure 5:
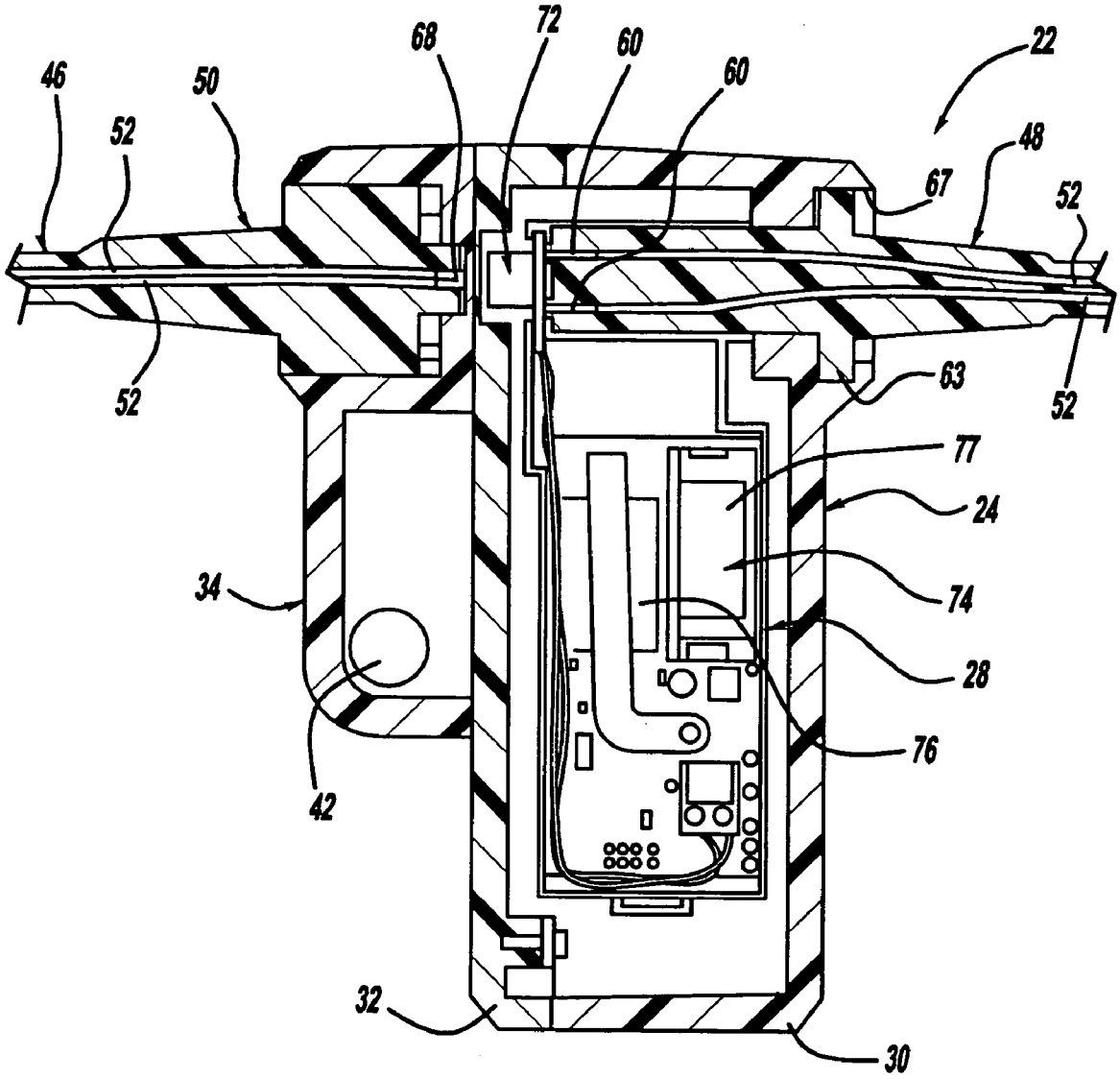
FIG. 5 is a cross-sectional view of the cable lock device of FIG. 1A.
Figure 7:
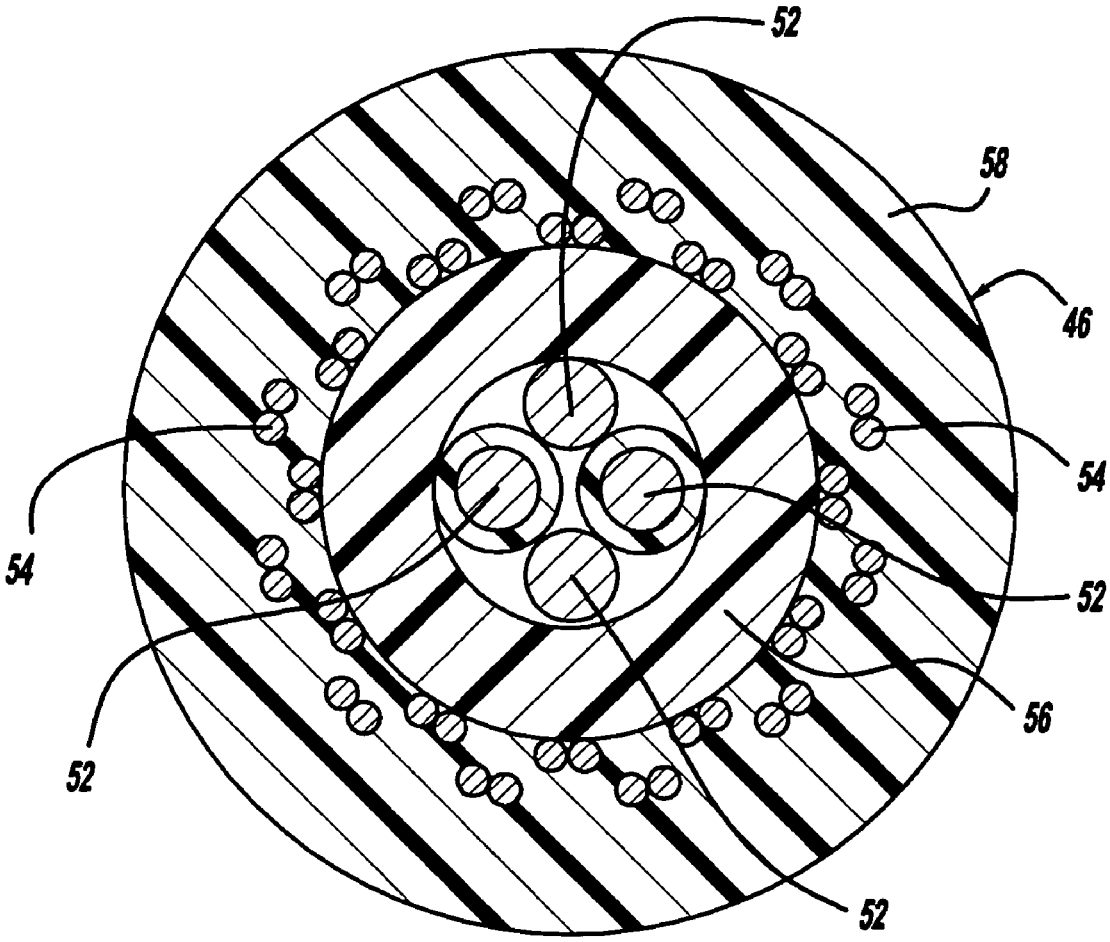
FIG. 7 is a cross-section of a cable of the cable lock device of FIG. 1A.

With particular reference to FIGS. 4, 5, and 7, the cable assembly 26 includes a cable 46, a fixed end 48, and a free end 50. The cable 46 includes at least two wires 52, a metal wire mesh 54 made from a material such as stainless steel, an inner insulator 56, and an outer insulator 58. The wires 52 extend along the length of the cable 46 and are attached generally at the free end 50 by a soldering or a crimp 53, and thus provide an electrical path between the fixed and free ends 48, 50. In addition, so-called "dummy" wires 52 may also be included within the cable 46 that do not transmit current between the respective ends 48, 50 and are simply disposed within the cable 46 to disguise the current-carrying wires 52. It should be understood that while two wires 52 are disclosed as "current-carrying" wires that any number of wires 52 may be provided within the cable 46 to carry current between the fixed and free ends 48, 50 and may even include a single wire that extends the length of the cable 46, initiating and terminating at the tampering subsystem 28 and looping at the free end 50. Furthermore, it should be understood that any number of dummy wires 52 could also be used.

The metal wire mesh 54 is disposed generally between the inner and outer insulators 56, 58 to protect the wires 52 and inner insulator 56. For example, if the outer insulator 58 of the cable 46 is cut by a cutting tool such as a knife or a razor blade (neither shown), the metal wire mesh 54 prevents further intrusion of the cutting tool into the cable 46, thereby protecting the inner insulator 56 and wires 52.

In addition to increasing the cut resistance of the cable 46, the metal wire mesh 54 also protects against wire tampering by making it difficult to reach the wires 52. Specifically, the mesh 54 protects the cable 46 by requiring severance or separation of the mesh 54 to allow access to the wires 52. Severance of the mesh 54 is difficult due the strength of the stainless steel construction and its disposition within the insulators 56, 58. Similarly, separation is challenging due to the mesh construction and its location between the insulators 56, 58. In one embodiment, the wire mesh 54 is molded between the insulators 56, 58 such that the insulating material of the inner and outer insulators 56, 58 is allowed to flow into the wire mesh 54. In this regard, the insulating material makes it is increasingly difficult to separate individual strands of the metal wire mesh 54 or to know exactly how deep to cut the cable 46 in an effort to tamper with the wires 52.

The fixed end 48 of the cable 46 includes a pair of terminals 60 and an attachment fitting 62. The terminals 60 electrically connect the wires 52 to the tampering subsystem 28 via a pair of conductors 55 while the attachment fitting 62 fixedly attaches the fixed end 48 to the housing 24 generally at half 30. The attachments fitting 62 includes a series of ribs 65 that ridially extend from an outer circumference of the attachment fitting 62. The ribs 65 are assembled to the housing 24 at half 30 and prevent extraction of the fitting 62 from the housing 24 once half 30 is fixedly secured to half 32.

The free end 50 of the cable 46 includes a pair of flanges 64, a location slot 66, and a magnet 68. The flanges 64 are matingly received by the grooves 38 of lock fitting 34 while the location slot 66 is matingly received by guidepost 40 to properly align the free end 50 with the housing 24. When the lock fitting 34 is rotated away from attachment aperture 44 and into an unlocked position, the location slot 66 aligns with the guidepost 40 to properly align the free end 50 with the fitting 34 (i.e., such that the flanges 64 are aligned with the recesses 36). Once the free end 50 is properly aligned, the flanges 64 are allowed to traverse the recess 36 via grooves 38.

Once the flanges 64 have reached the bottom of the recess 36, the lock fitting 34 and free end 50 are permitted to rotate together relative to the housing 24 and into a locked position. Sufficient rotation of the fitting 34 and free end 50 relative to the housing 24 prevents extraction of the free end 50 from the housing 24. Specifically, when the lock fitting 34 is in the unlocked position, the flanges 64 are permitted to traverse the recess 36 within grooves 38 and between the projections 39. When the flanges 64 reach the bottom of the recess 36, the flanges 64 are rotated along with the lock fitting 34 until the flanges 64 engage a pair of lock projections 41 disposed at the bottom of the recess 36. The lock projections 41 are fixed to the housing 24 such that the lock fitting 34 and free end 50 are permitted to rotate relative thereto. Sufficient rotation of the lock fitting 34 and the free end 50 causes the flanges 64 to engage the lock projections 41, thereby preventing extraction of the free end 50 from the housing 24.

Once the lock fitting 34 has been sufficiently rotated into the locked position such that the flanges 64 are seated within the lock projections 41, the apertures 42 of the lock fitting 34 align with aperture 44 of the housing 24. Alignment of the apertures 42, 44 allows a locking device such as, but not limited to, a combination lock, to be inserted between the lock fitting 34 and the housing 24 to prevent rotation of the lock fitting 34 from the locked position to the unlocked position. At this point, the free end 50 is fixed relative to the housing 24 and the cable lock device 22 is in a locked state.

Figure 6:
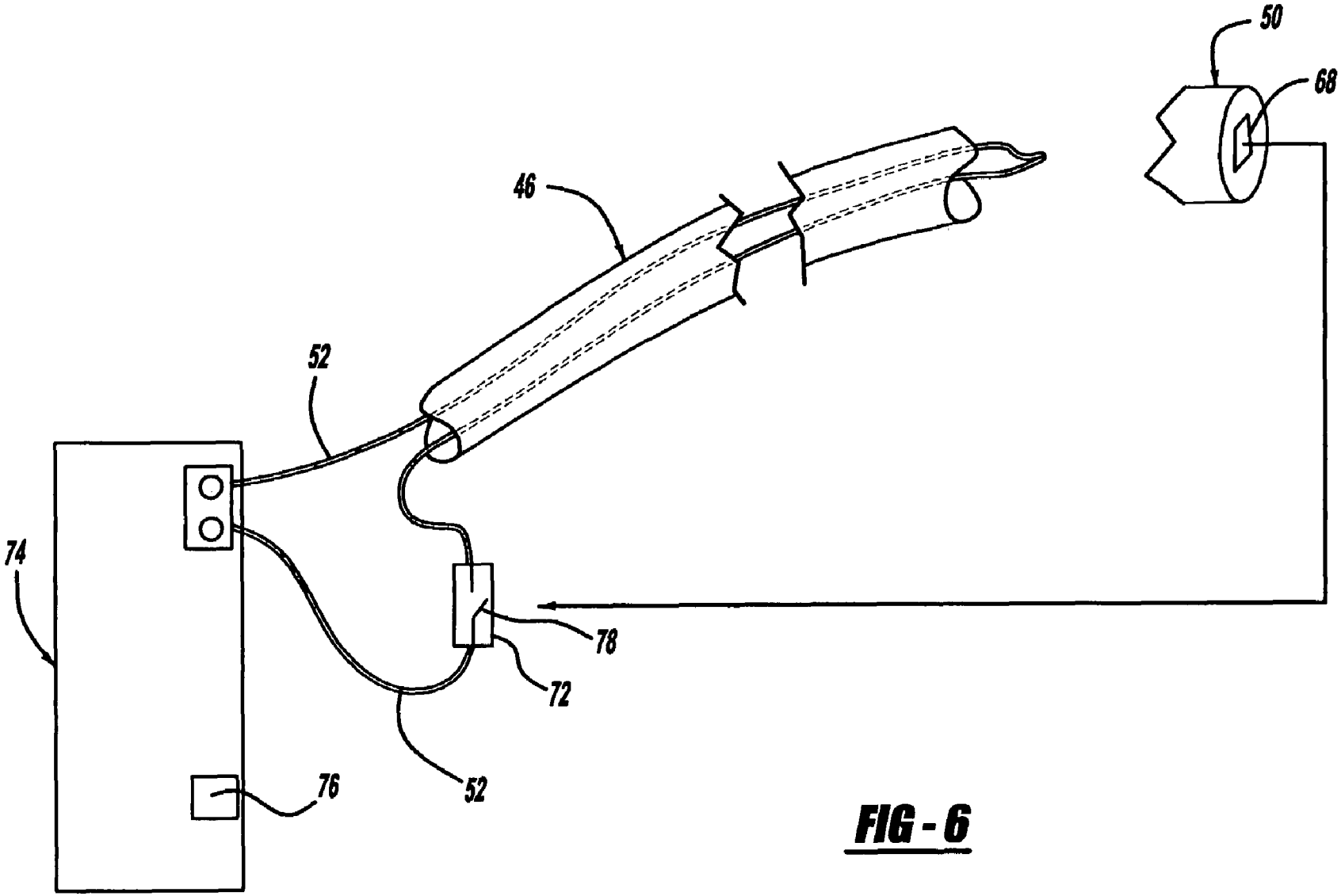
FIG. 6 is a circuit diagram for the cable lock device of FIG. 1A.

With particular reference to FIGS. 5 and 6, the tampering subsystem 28 includes a reed sensor 72, control circuitry 74, a transmitter 76, and a power source 77. The reed sensor 72 is disposed generally within the housing 24 such that when the free end 50 is fully seated within recess 36, the reed sensor 72 is in proximity to the magnet 68. The reed sensor 72 detects the presence of the magnet 68, and thus the free end 50, and closes a switch 78 when the free end 50 is disposed within the housing 24.

The control circuitry 74 is in communication with the reed sensor 72 and the switch 78 such that the position of the switch is monitored by the control circuitry 74. The control circuitry 74 may include a combination of analog circuitry or a microcontroller to determine and monitor the status of the switch 78 (i.e., open or closed). Once the status of the switch 78 is determined, the control circuitry 74 instructs the transmitter to update the control unit 12 as to the switch status. It should be understood that while a transmitter 76 is described, that the tampering subsystem 28 could alternatively include a transceiver such that two-way communication between the cable lock device 22 and the control unit 12 is possible.

When the switch 78 is closed, a closed circuit condition results and current is allowed to flow through the wires 52 and switch 78. Conversely, when the free end 50 is not fully seated within the recess 36, the magnet 68 will not close the switch 78, and an open circuit condition results (i.e., no continuity). In operation, the control circuitry 74 sends an event message to the control unit 12 via transmitter 76 to continuously update the control unit 12 with the status of the circuit (i.e., open or closed). Therefore, when either the cable 46 is severed, or the free end 50 is disengaged from the housing 24, the circuit is opened and an event message is sent to the control unit 12 to sound an alarm, as will be described further below.

In another aspect of the invention, the cable lock device 22 could alternatively include separate circuits that respectively monitor the condition of the cable 46 and the disposition of the free end 50. Specifically, the cable lock device 22 could include a first circuit electrically coupled to the reed sensor 72 that monitors the position of free end 50 (i.e., connected or disconnected form the housing 24) and a second circuit having a current path extending from the control circuitry 74 and through the length of the cable 46 that monitors the status of the cable 46 (i.e., cut or intact). Therefore, the status of the cable 46, and the disposition of the free end 50 of the cable 46, are monitored by separate circuits.

In operation, the cable lock device 22 is first attached to a building or property to be protected such as, for example, the front loader 16 of FIGS. 1 and 1A. The cable 46 may be looped around a door handle 94 and a railing 96 of the front loader 16 such that a door 98 is restricted from fully opening and access to the front loader is restricted. Once the cable lock device 22 is looped around the property, and the free end 50 is fixedly attached to the housing 24, the control unit 12 can be actuated into an armed state. When the control unit 12 is in the armed state, event messages, sent by the control circuitry 74 via transmitter 76, are received and processed by the control unit 12 to continually monitor the disposition of the cable 46.

The event messages relay status information to the control unit 12 to allow the control unit 12 to monitor the cable lock device 22 and ensure that the cable 46 remains intact, that the free end 50 remains fixedly attached to the housing 24, and that the housing halves 30, 32 remain fixedly attached to each other, as will be described further below. Once the free end 50 is fixedly attached to the housing 24, the only way to open the door 98 is to either disconnect the free end 50 from the housing 24 or to sever the cable 46.

In addition to electronic protection via the control unit 12, it should be understood that the cable lock device 22 may further include the ability to be secondarily locked by insertion of a lock device (not shown) through apertures 42, 44 to effectively prevent rotation of the lock fitting 34 and removal of the cable 46. Such secondary locking capability prevents rotation of the lock fitting 34 and removal of the free end 50, regardless of control unit 12 and the control circuitry 74. This configuration provides additional security for the device 22, but can also be used independent of the electronic control (i.e., independent of the control unit 12).

The control circuitry 74 continuously monitors the cable 46 for an open circuit condition. As previously discussed, an open circuit condition occurs when any of the current-carrying wires 52 are severed at any point along their length or if the free end 50 of the cable 46 is removed from the housing 24. The control circuitry 74 continuously updates the control unit 12 as to the status of the cable lock device 22. However, it should be understood that the control unit 12 could alternatively be configured to only update the control unit 12 when a tampering event occurs (i.e., an open circuit condition). In either situation, the control circuitry 74 communicates with the control unit 12 via transmitter 76. If the free end 50 of the cable 46 is removed from the housing 24, or if any of the wires 52 are severed at any point, the circuit formed between the control circuitry 74 and the cable (via wires 52) is opened. The open circuit condition is detected by the control circuitry 74 and relayed to the control unit 12 via transmitter 76. Once an open circuit condition is realized, the control unit 12 informs the owner of the property by sounding an alarm and/or sending the open circuit event to the remote monitoring system 13 to further alert a response team such as a police or fire department.

While such one-way communication is disclosed, it should be understood that two-way communication between the cable lock device 22 and the control unit 12 is also anticipated, whereby the control unit 12 communicates with a transceiver (not shown) of the cable lock device 22 to selectively instruct the control circuit to update the control unit 12 with cable status information. For example, the control unit 12 could selectively instruct the cable lock device 22 into an armed state such that the cable lock device 22 only transmits a signal to the control unit 12 when in the armed state (i.e., on demand).

In addition to the foregoing, a switch 84 may be disposed within the housing 24 to monitor tampering of the control circuitry 74. The switch 84 is disposed within a protective cover 86 generally proximate to the control circuitry 74 and is movable between an open position and a closed position by a finger 85. The finger 85 is integrally formed with the protective cover 86 and selectively depresses the switch 84 to toggle the switch 84 between the open and closed positions, as will be described further below.

In operation, the finger 85 toggles the switch 84 into the closed position when the protective cover 86 is engaged with the half 30. Specifically, the half 30 applies a force to the finger 85 such that the finger 85 depresses the switch 84 into the closed position. At this point, the closed condition of the switch 84 indicates to the control circuitry 74 that the protective cover 86 is safely disposed within the housing half 30. On the other hand, if the halves 30, 32 are separated such that the cover 86 is separated from half 30, the switch 84 opens, and an event message is sent to the control unit 12 via transmitter 76 that the control circuitry is vulnerable. When the switch 84 is opened (by release of finger 85 from contact with housing 30), the control unit 12 alerts a user and/or the remote monitoring system 13 that the property being protected by the cable lock device 22 may be vulnerable.

Figure 8:
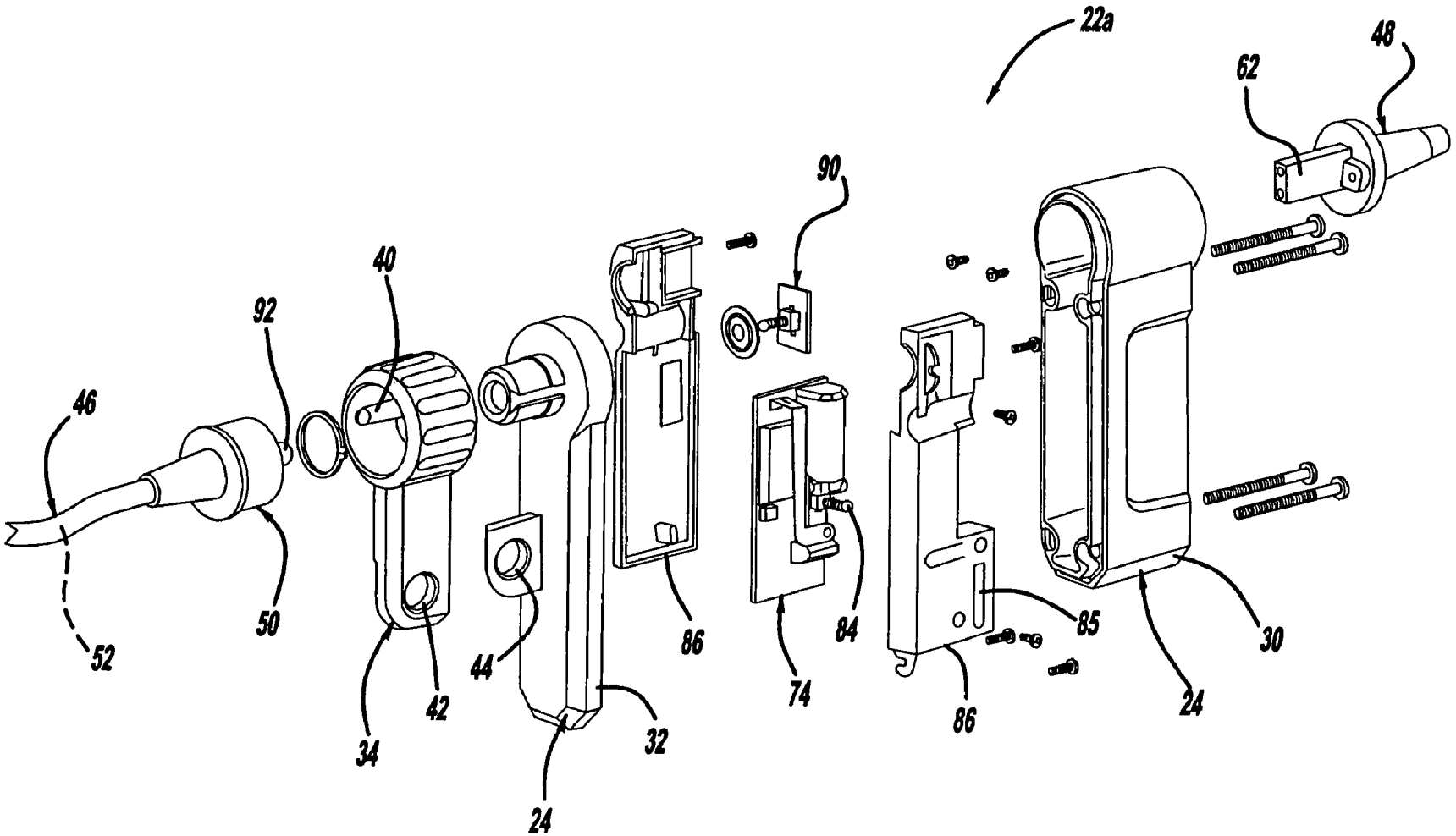
FIG. 8 is an exploded view of another cable lock device for the security system of FIG. 1 in a locked state.
Figure 9:
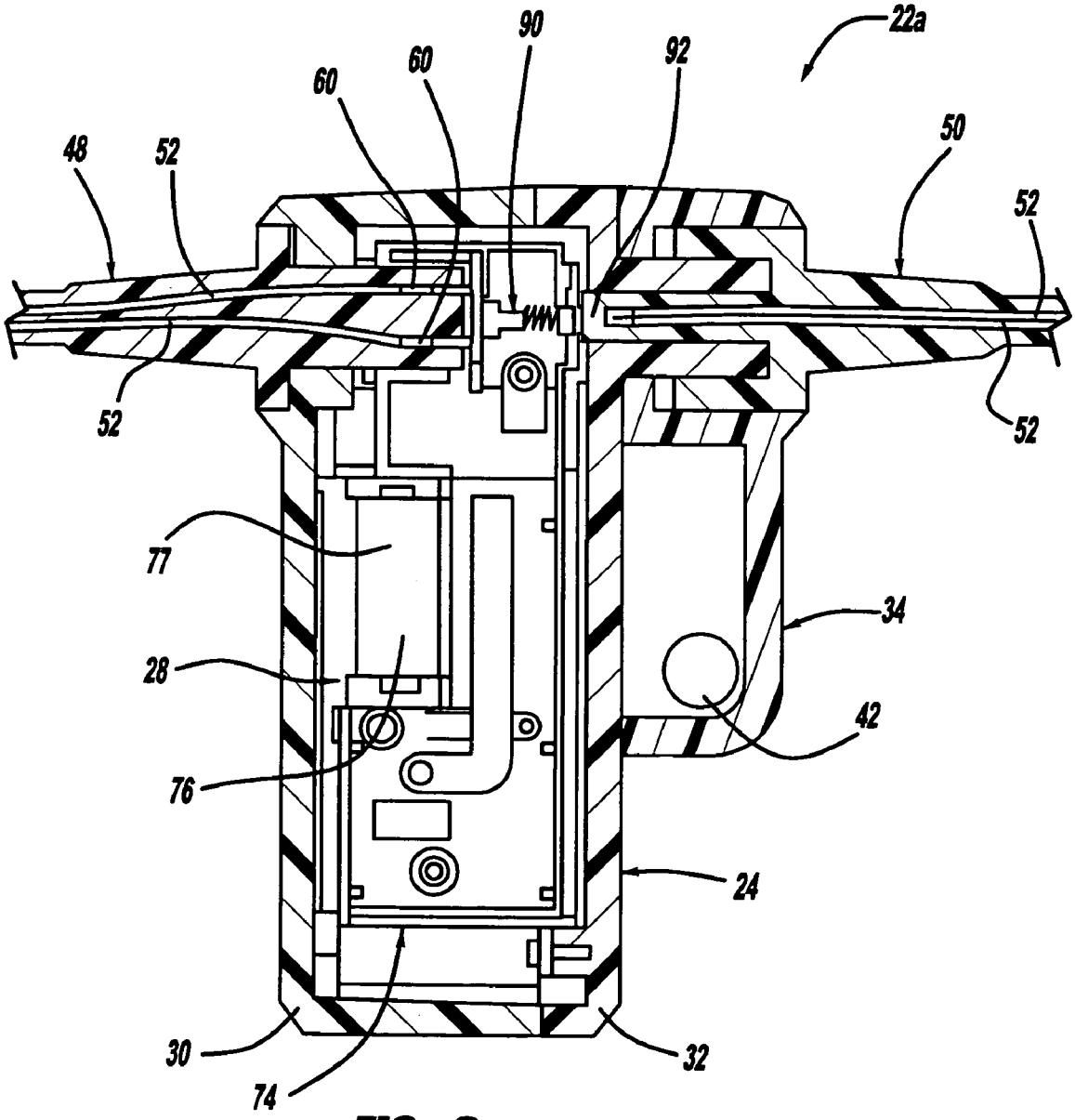
FIG. 9 is a cross-sectional view of the cable lock device of FIG. 8.

With particular reference to FIGS. 8-9, another cable lock 22*a* in accordance with the principals of the present invention is provided. In view of similarity between cable lock 22*a* and cable lock 22, like reference numbers will be used hereinafter and in the drawings to denote like components.

The cable lock 22*a* functions in a similar manner to that of cable lock 22, except that a positional switch 90 is used in place of the reed sensor/magnet relationship. The positional switch 90 determines if the free end 50 is disposed within the recess 36 and thus, whether the cable 46 is attached to the housing 24.

The free end 50 includes a projection 92 that physically depresses the switch 90 and closes the circuit between the wires 52 and the control circuitry 74. When the free end 50 is properly seated within the recess 36, the projection 92 extends far enough into the housing 24 so that the switch 90 is depressed and the circuit is closed. Again, when the circuit is closed, the cable lock 22*a* is in the armed state and an open circuit condition will cause the control circuitry 74 to alert the control unit 12 that the cable lock device 22 has been breached.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cable lock device comprising:

a housing;

a cable having a first end fixedly attached to said housing, a second end which selectively attaches to said housing, and at least one wire disposed within said cable;

a switch disposed within said housing and configured to detect when the second end of said cable is attached to said housing; and a tampering subsystem disposed within said housing, said tampering subsystem operable to detect whether said cable is cut at any point along its length;

wherein said at least one wire is electrically coupled to said tampering subsystem through only one end of said cable when said second end is attached to said housing.

2. The cable lock device of claim 1, wherein said tampering subsystem includes control circuitry, said control circuitry electrically coupled to said at least one wire such that said control circuitry monitors said at least one wire for an open circuit condition.

3. The cable lock device of claim 2, wherein said at least one wire extends substantially throughout a length of said cable and is thereby configured to detect when said cable is cut at any point along said length of said cable.

4. The cable lock device of claim 2, further comprising a transmitter in data communication with said control circuitry and operable to transmit an alarm message when said control circuitry detects an open circuit condition.

5. The cable lock device of claim 4, wherein said transmitter transmits said alarm message to a remotely located monitoring system.

6. The cable lock device of claim 2, wherein said control circuitry includes a microcontroller.

7. The cable lock device of claim 1, wherein said at least one wire is electrically coupled at both ends to control circuitry of said tampering subsystem and said switch is interposed along a circuit path formed by said at least one wire, wherein said control circuitry supplies power to said circuit path and is operable to detect an open or closed circuit condition along said circuit path.

8. The cable lock device of claim 1, further comprising a tamper switch disposed within said housing, said tamper switch operable to detect opening of said housing.

9. The cable lock device of claim 1, wherein said second end of said cable includes a projection operable to actuate said switch into a closed state when said second end is attached to said housing.

10. The cable lock device of claim 1, wherein said switch is a reed sensor.

11. The cable lock device of claim 10, wherein said second end of said cable includes a magnet, said magnet operable to actuate said reed sensor into said closed state when said second end of said cable is attached to said housing.

12. The cable lock device of claim 1, wherein said cable includes a wire mesh.

13. A cable lock device comprising:

a housing;

a cable having a first end fixedly attached to said housing, a second end that selectively attaches to said housing, and a wire including a first end and a second end disposed within said cable;

a switch disposed within said housing and configured to detect when the second end of said cable is attached to said housing; and a tampering subsystem disposed within said housing and operable to detect whether said cable is cut at any point along its length;

wherein said first end and said second end of said wire are electrically coupled to said tampering subsystem at said first end of said cable.

14. The cable lock device of claim 13, wherein said wire extends substantially along a length of said cable.

15. The cable lock device of claim 13, wherein said wire is electrically isolated from said tampering subsystem at said second end of said cable when said second end of said cable is attached to or disengaged from said housing.

16. The cable lock device of claim 13, wherein said wire extends from said first end of said cable to said second end of said cable and back to said first end of said cable.

* * * * *